United States Patent [19]

Gelez

[11] 4,414,446

[45] Nov. 8, 1983

[54] ELECTRIC ARC COOLING APPARATUS FOR THE CHIMNEYS OF CUT-OUT DEVICES

[75] Inventor: Jean-Philippe Gelez, Saint Mande, France

[73] Assignee: Societe Anonyme dite Alsthom-Atlantique, Paris, France

[21] Appl. No.: 202,217

[22] Filed: Oct. 30, 1980

[30] Foreign Application Priority Data

Oct. 31, 1979 [FR] France ..... 79 27013

[51] Int. Cl.[3] ..... H01H 33/08

[52] U.S. Cl. ..... 200/144 R; 200/148 C

[58] Field of Search ..... 200/148 C, 144

[56] References Cited

U.S. PATENT DOCUMENTS

| | | | |
|---|---|---|---|
| 1,984,396 | 12/1934 | Clerc | 200/148 C |
| 2,362,798 | 11/1944 | Bold | 200/148 C |
| 2,980,781 | 4/1961 | Legg et al. | 200/148 C |

FOREIGN PATENT DOCUMENTS

| | | | |
|---|---|---|---|
| 895927 | 4/1944 | France | 200/148 C |
| 950233 | 3/1949 | France | 200/148 C |
| 568967 | 4/1945 | United Kingdom | 200/148 C |

*Primary Examiner*—Robert S. Macon

*Attorney, Agent, or Firm*—Sughrue, Mion, Zinn, Macpeak and Seas

[57] ABSTRACT

A cooling apparatus which enables cut-out devices to be of compact design. A ceramic cooling unit (1) has cells (2) which pass right through it and has partitions (3) which are thin relative to one side of the cross-section of a cell (2).

1 Claim, 5 Drawing Figures

ELECTRIC ARC COOLING APPARATUS FOR THE CHIMNEYS OF CUT-OUT DEVICES

The present invention relates to an electric arc cooling apparatus for chimneys of cut-out devices such as circuit-breakers or contactors used for high currents.

BACKGROUND OF THE INVENTION

In this type of apparatus, it is known that to quench the electric arc which occurs between contacts when a cut-out device is switched off a magnetic field may be used to direct the electric arc towards a chimney which may be shaped like a truncated pyramid ending in a cooling apparatus. Said chimney is provided to length en the electric arc so that its resistance increases until it is quenched.

The efficiency of the cooling apparatus must be high, i.e. the temperature of the gases which emerge therefrom must be as low as possible so as to reduce as far as possible the safety gap which must always be provided in front of the chimney. There are numerous types of cooling apparatus some of which are produced in the form of units with pluralities of circular holes passing right through them which holes allow the plasma to flow through them. These units are made of an insulating plastic, thermoplastic or refractory material. However, due to the fact that the refractory units are drilled, the cylindrical holes are of relatively small cross-section. This results in a high loss of head in the plasma flow. Further, the contact surface area between the gases and the insulating portions which are needed for cooling is necessarily reduced. In other apparatuses, the arc quenching chambers have thick cell partitions fixed on them by screws, said partitions not being compact.

The cooling apparatus in accordance with the present invention remedies these drawbacks. Indeed, in the present invention, the plasma flow is easy although cooling thereof is more effective and the apparatus is as compact as possible.

SUMMARY OF THE INVENTION

The present invention provides an electric arc cooling apparatus for chimneys of cut-out devices, said apparatus including at least one unit made of a refractory ceramic material, the cross-section of said unit having cells passing through it, wherein the thickness of the partitions of said cells is less than or equal to one fifth of one of the cross-sections of said cell.

BRIEF DESCRIPTION OF THE DRAWINGS

Embodiments of the invention are described by way of example with reference to the accompanying drawings in which.

DESCRIPTION OF PREFERRED EMBODIMENTS

Figure 1:
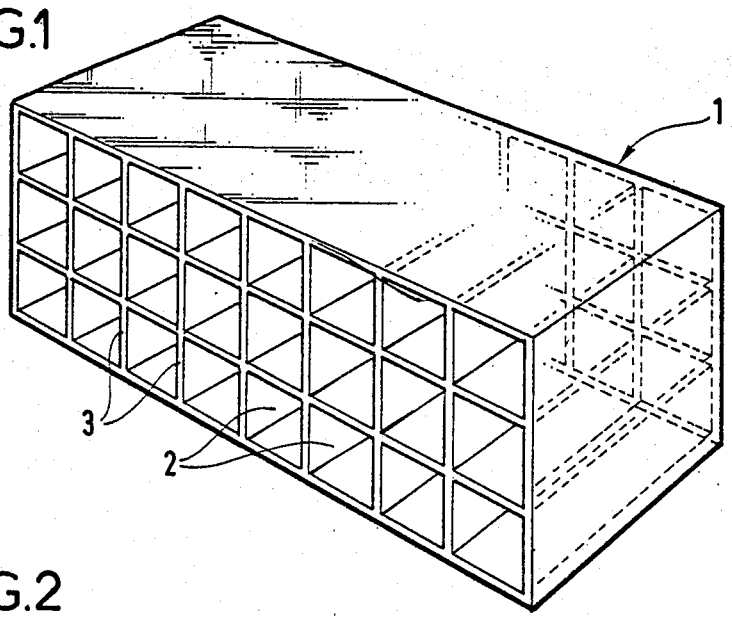
FIG. 1 is a schematic perspective view of a square-celled cooling unit which forms part or the whole of an apparatus in accordance with the invention.

FIG. 1 illustrates a cooling unit 1 made of a refractory material such as a ceramic and constituted by square cells 2 separated by very thin partitions 3, e.g. 6/10ths of a millimeter thick. The cells 2 are, for example, 34/10ths of a millimeter wide. Thus, the ratio between the thickness of the partitions 3 and the width of the cells 2 is less than 0.2.

The units are designed to withstand the passage of an electric arc without sustaining damage even though said arc is at several thousands of degrees centigrade and to absorb most of the heat energy of said arc. Due to the thinness of the partitions 3 and to the large cross-section of the cells 2 the plasma flows without any great loss of head. Indeed, in our example, for a unit 1 with a cross-section of $12\times50$ millimeters the total surface area of the cells 2 is about 400 square millimeters.

Figure 2:
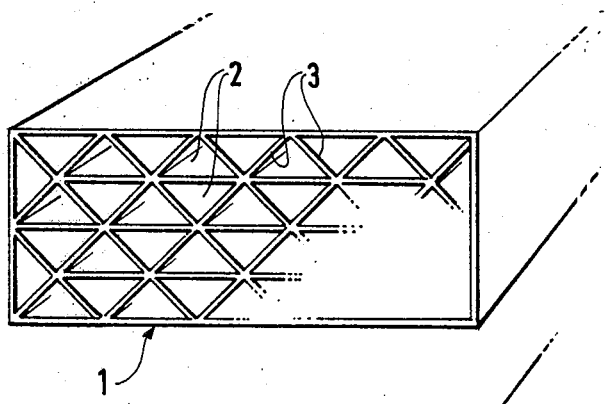
FIG. 2 is a schematic perspective view of a triangular-celled cooling unit which forms part or the whole of an apparatus in accordance with the invention.
Figure 3:
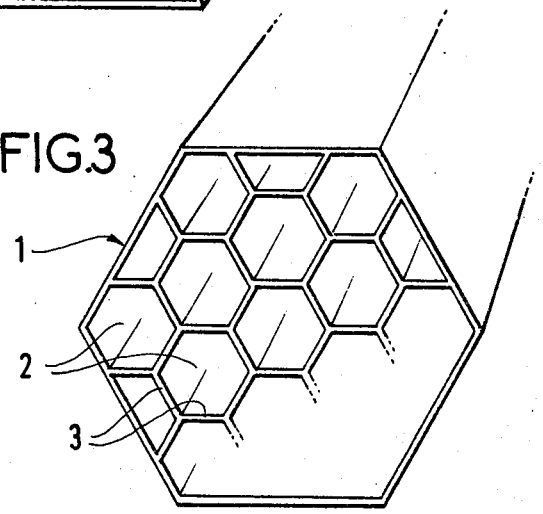
FIG. 3 is a schematic perspective view of a hexagonal-celled cooling unit which forms part or the whole of an apparatus in accordance with the invention.

The cells 2 can be of triangular shape (FIG. 2) or of hexagonal shape (FIG. 3) provided the partitions 3 are thin and the empty space is large; the cooling unit 1 can be of triangular or hexagonal cross-section in addition to the rectangular cross-section shown in FIGS. 1 and 2.

If the temperature measured by a thermocouple at the end of a chimney which has no cooling unit 1 is taken to be unity, the measured temperature is only $\frac{1}{8}$ when a cooling unit 1 of length L (which may be 30 millimeters) is disposed at the outlet of the chimney.

Figure 4:
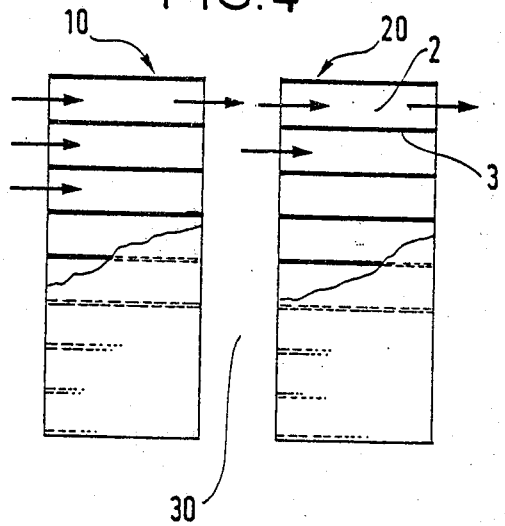
FIG. 4 is a transversal cross-section of two aligned cooling units separated by a gap.

FIG. 4 illustrates two cooling units 10 and 20 each of length L/2 and disposed one after the other along the same axis with a gap 30 of 1 centimeter for example between them. In this case, the temperature measured after the second unit is now only 1/32 of the temperature without cooling apparatus.

Figure 5:
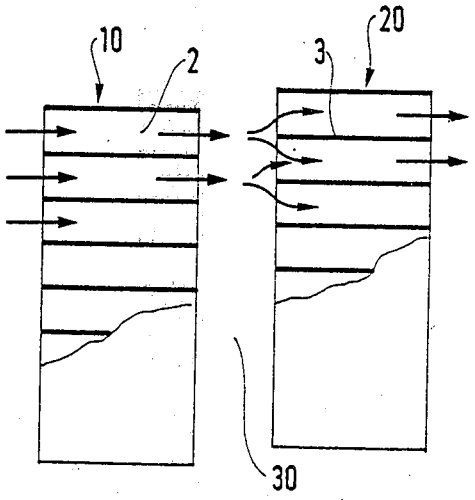
FIG. 5 is a transversal cross-section of two staggered cooling units separated by a gap.

FIG. 5 illustrates two cooling units 10 and 20 each of length L/2 and each separated by a gap 30 and disposed one after the other but staggered in such a way that the partitions 3 of the second unit are disposed in line with the centres of the cells of the first unit. In this case, the temperature measured is only 1/64th of the temperature without cooling apparatus.

The use of the cooling apparatus in accordance with the invention installed in the chimney of a circuit-breaker or of a contactor for operation at tensions of 3000 volts and currents of several thousands of amps, enables such a circuit breaker or contactor to be of much more compact design and also enables the safety gap at the front of the chimney to be reduced.

The invention is particularly applicable to DC or AC circuit-breakers for use in railroad technology.

I claim:

1. An electric arc cooling apparatus for chimneys of cut-out devices, said apparatus including at least one unit made of a refractory ceramic material including intersecting partitions forming in cross-section for said unit, cells passing through it, and wherein the thickness of the partitions defining said cells is less than or equal to one fifth of the width of said cells; whereby, the arc plasma flows through the cells without great loss of head and without sustaining damage, even though said arc may be at several thousand degrees, and said unit functions to absorb most of the heat energy of said arc.

* * * * *